US006562202B2

(12) United States Patent
Beier et al.

(10) Patent No.: US 6,562,202 B2
(45) Date of Patent: May 13, 2003

(54) DRUM FOR ELECTROPOLISHING BULK METAL PARTS

(75) Inventors: Ottmar Beier, Hemer (DE); Hagen Hans Wolff, Neumarkt/Oberpfalz (DE)

(73) Assignee: Linnhoff & Pasternak GmbH, Unna (DE)

( * ) Notice: Subject to any disclaimer, the term of this patent is extended or adjusted under 35 U.S.C. 154(b) by 0 days.

(21) Appl. No.: 09/889,188

(22) PCT Filed: Dec. 6, 2000

(86) PCT No.: PCT/EP00/12251

§ 371 (c)(1),
(2), (4) Date: Jul. 12, 2001

(87) PCT Pub. No.: WO01/42538

PCT Pub. Date: Jun. 14, 2001

(65) Prior Publication Data

US 2002/0179432 A1 Dec. 5, 2002

(30) Foreign Application Priority Data

Dec. 10, 1999 (DE) ..... 199 59 490

(51) Int. Cl.[7] ..... C25D 17/00
(52) U.S. Cl. ..... 204/213; 204/272
(58) Field of Search ..... 204/213, 214, 204/224 M, 272

(56) References Cited

U.S. PATENT DOCUMENTS 2,853,447 A 9/1958 Hackenburg

FOREIGN PATENT DOCUMENTS

GB 934 830 8/1963

*Primary Examiner*—Donald R. Valentine
(74) *Attorney, Agent, or Firm*—Collard & Roe, P.C.

(57) ABSTRACT

Proposed is a drum 1 for electropolishing bulk metal parts, in particular stainless steel parts, comprising a drum jacket 12 made of metal and equipped with a filling opening 13 located on the side of the jacket, and a concentrically arranged cathode 3, whereby provision is made in the drum 1 for a space 2, 10 for receiving the metal parts, said space being closed on all sides and forming the anode and being arranged concentrically with a spacing 8, 9 in relation to the drum jacket 11 and the concentric cathode 3.

7 Claims, 2 Drawing Sheets

DRUM FOR ELECTROPOLISHING BULK METAL PARTS

CROSS REFERENCE TO RELATED APPLICATIONS

Applicants claim priority under 35 U.S.C. §119 of German Application No. 199 59 490.2 filed Dec. 10, 1999. Applicants also claim priority under 35 U.S.C. §120 of PCT/EP00/12251 filed Dec. 6, 2000. The international application under PCT article 21(2) was not published in English.

The invention relates to a drum for electropolishing bulk metal parts, in particular stainless steel parts.

Known and commercially available is a drum for electropolishing bulk stain steel parts that rotates with current-conducting support arms in an electrolyte bath. The cathode is formed in this connection by a tube that is centrally and coaxially arranged in the interior of the drum. The anode is formed by the jacket of the drum. For the electropolishing operation, the bulk stain steel parts are filled in said drum only to such a degree of filling at which it is assured that the stain steel parts to be polished will not come into contact with the cathode, because that would otherwise cause disruptive discharges and burning of the parts to be treated, which has to be avoided. Therefore, only small amounts of bulk stain steel parts can be accordingly treated in such drums.

Due to the currents passed through the electrolytes, charge transports of ions are achieved in connection with such an electropolishing process. Surface portions are removed in the processes for electropolishing accordingly, and moved to the cathode.

A device for the electrolytic polishing particularly of small metal parts is known already from DE 2 009 189 A1, in which a tubular anode is concentrically arranged in the receiving drum. Provision is made on said tube on the end sides for flaps, which are spaced from each other and have stepped diameters in accordance with the shape of the drum. Only a low degree of filling can be achieved with such a drum as well.

The problem of the invention is to propose a drum of the type specified above, in which greater amounts of bulk stain steel parts, in particular small parts can be treated.

The problem of the invention is solved with a drum having the features of claim 1. A preferred type of embodiment of the invention is specified in claim 2.

By arranging a ring-shaped drum forming the anode and receiving the metal parts, in particular the stainless steel parts, with a spacing from the jacket of the actual drum, it is assured that the stainless steel parts to be treated cannot come into contact with the centrally arranged cathode. Taking into account the clear space required between the two drums, it is possible in this way to obtain space for receiving and treating the stainless'steel parts. With respect to the diameter and the size of the actual drum, such space can receive a substantially larger proportion of the volume than the filling space within the known drums of this type available until now. Drums of the type as defined by the invention are therefore by far more effective than the known drums of said type.

Preferably employed construction variations and elements are specified in the dependent claims and explained in greater detail in the following.

The associated drawings show the following:

Figure 1:
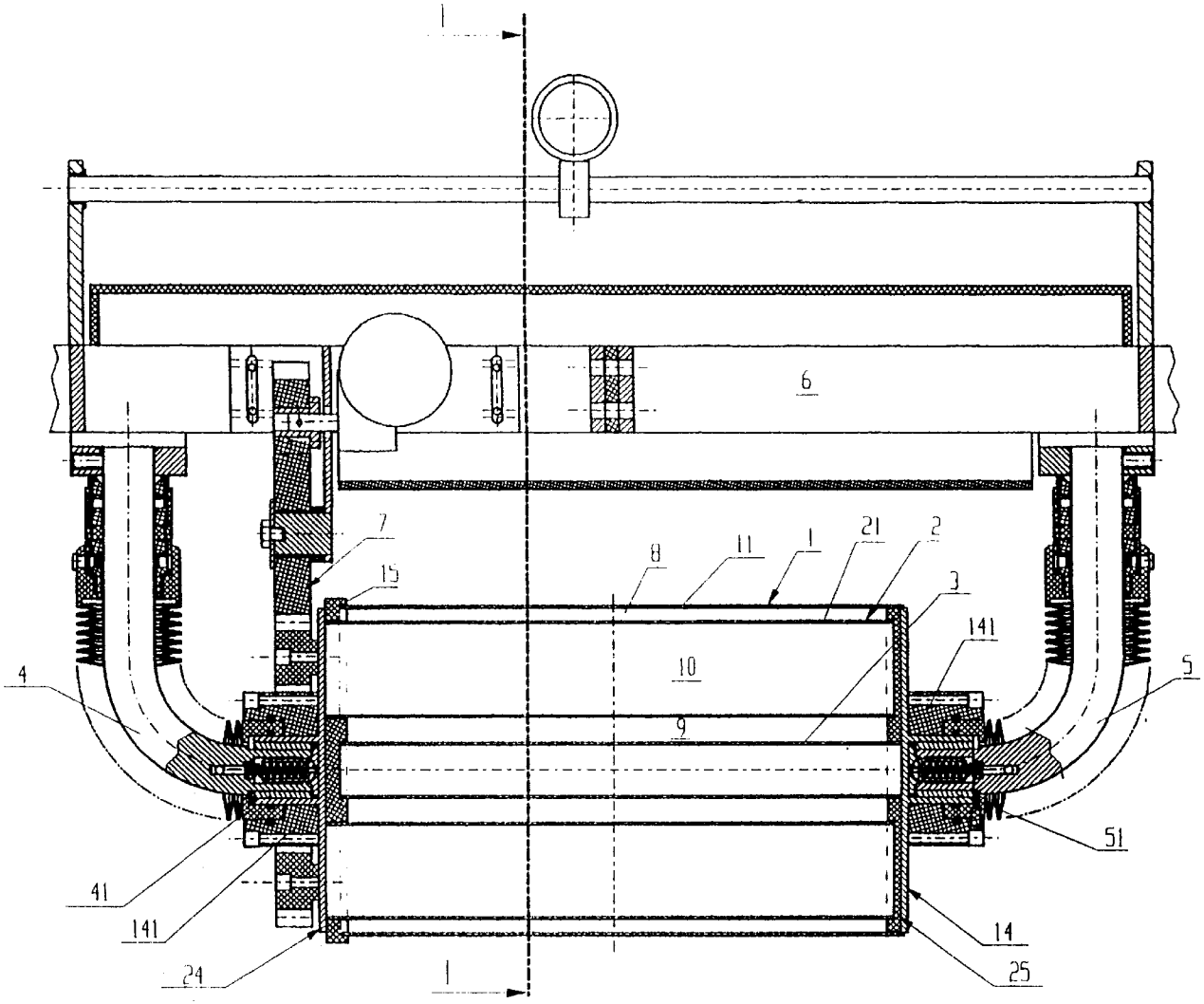
FIG. 1 shows a longitudinal section through a drum.

The drum 1 forming a cathode has a jacket 11 that is made of metal and perforated, as a rule. Provision is made on the side of the jacket for a filling opening 12 that extends over the entire length of the drum. Said filling opening is defined by the plastic rods 13, which connect the drum 1 with a concentric interior drum 2 having a ring-shaped cross section. Said interior drum 2 as such forms an anode space and is therefore arranged in an electrically insulated manner vis-a-vis the drum 1.

The drum 2 with the ring-shaped cross section, which is made of metal as well, is received in a rotatable manner on the support arms 4, 5, or their bearing ends 41 and, respectively, 51, said support arms partly conducting current. The bearings are denoted by the reference numerals 141. Said support arms are suspended on the support frame 6. Said support frame 6 also receives the drive by which the drum 2 with the ring-shaped cross section is driven via the transmission 7, said drum 2 being connected to a corresponding spur gear. Said drum 2 is in a driving connection with the drum 2. On the side opposing its face wall 24, the drum 2 engages an electrically insulating face wall 25 and rests with said face wall against the face wall 14 of the drum 1, said latter face wall being connected with the jacket 11.

The concentric spacing 8 between the drum 1 and the drum 2 is maintained via the face wall 15, which is made of an electrically insulating material. Provision is made for a clear space forming the spacing 9 between the drum 2 with the ring-shaped cross section, and the centrally arranged tube 3 forming a cathode as well, said tube extending over the length of the drum 2.

Figure 2:
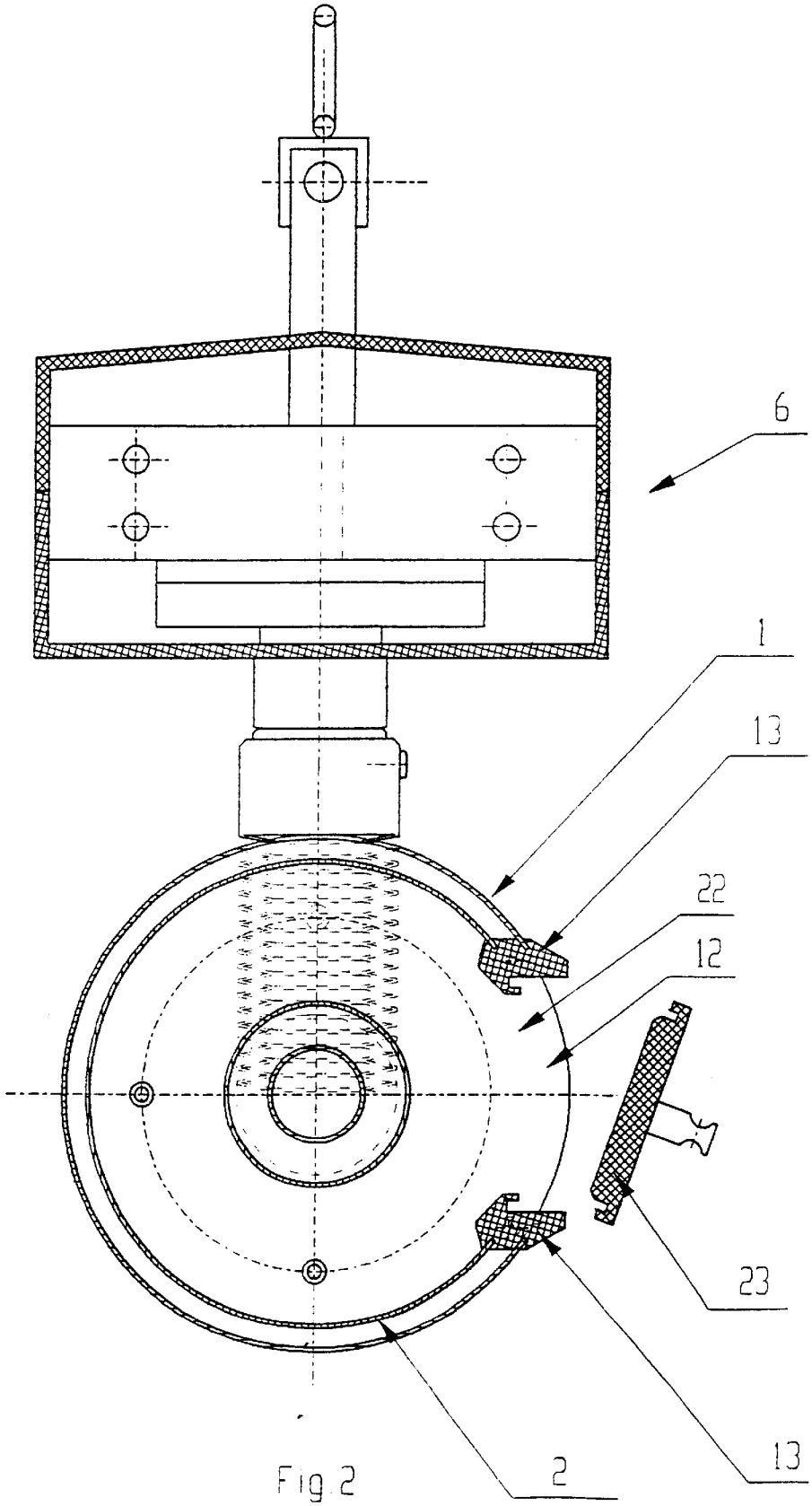
FIG. 2 shows a section according to line I—I, with the cover of the drum receiving the parts to be treated being open.

The filling space of the drum 2 having a ring-shaped cross section and forming the anode can be filled via the filling opening 22 shown in FIG. 2. Said filling opening can be sealed with a cover 23. Said cover 23 is held on the rods 13, which are connected in a driving manner with the two drums 1 and 2. The filling opening 22 of the drum 2 with the ring-shaped cross section corresponds with the filling opening 12 of the drum 1 or its jacket 11.

In the exemplified example shown, the two drums 1 and 2 are connected with one another in a driving manner and therefore jointly rotate in an electrolyte bath. However, it is conceivable also that the two drums are arranged in such a way permitting a relative movement of the two drums in the direction of rotation.

| List of Reference Numerals | |
|---|---|
| 1 | Drum |
| 12 | Jacket |
| 13 | Filling opening |
| 14 | Face wall |
| 141 | Bearing |
| 15 | Face wall |
| 2 | Drum with ring-shaped cross section |
| 21 | Jacket |
| 22 | Filling opening |
| 23 | Cover |
| 24 | Face wall |
| 25 | Face wall |
| 3 | Cathode, tube |
| 4 | Support arm |
| 41 | End of bearing |
| 5 | Support arm |
| 51 | End of bearing with current feed |
| 6 | Support frame |
| 7 | Transmission |

-continued

| List of Reference Numerals |
|---|
| 8 Clear spacing |
| 9 Clear spacing |
| 10 Filling space |

What is claimed is:

1. A drum for electropolishing bulk stainless steel parts, comprising: a drum jacket made of metal and equipped with a filling opening on the side of the jacket, and a cathode in a form of a tube concentrically arranged therein, having a receiving space closed on all sides for receiving the stainless steel parts, said stainless steel parts forming an anode in the receiving space, and with the receiving space being arranged concentrically in the drum with a spacing from the drum jacket and the concentric cathode wherein said tube extends almost completely over a length of said drum jacket which receives the stainless steel parts.

2. The drum according to claim 1, wherein said receiving space for receiving the stainless steel parts is a drum with a ring-shaped cross section and having a filling opening on the side of the drum jacket, said filling opening being sealable by a cover.

3. The drum according to claim 2, wherein said drum jacket is connected in a driving manner with the drum having the ring-shaped cross section.

4. The drum according to claim 3, wherein said drum jacket is connected with the drum having the ring-shaped cross section via rods located within the zone of its opening.

5. The drum according to claim 4, wherein the rods defining the drum openings form the means for receiving the cover of the drum having the ring-shaped cross section.

6. The drum according to claim 1, wherein the drum being supported with its face wall on support arms and having a ring-shaped cross section engages on the opposite side an electrically insulating face wall, said face wall serving the purpose of maintaining the spacing from the external drum.

7. A drum for electropolishing bulk metal parts comprising:

a) a drum jacket made of metal and having a filling opening on a side of said drum jacket;

b) a cathode tube concentrically arranged in said drum jacket and extending over a substantial portion of a length of said drum jacket;

c) a drum having a ring-shaped cross section and having a filling opening;

d) a cover which can be coupled to said drum having a ring-shaped cross section for covering and sealing said filling opening; and e) at least one rod tar coupling said drum jacket to said drum having a ring-shaped cross section, wherein said drum and said drum jacket are coupled together in a driving manner, wherein said drum having a ring shaped cross section has a receiving space formed therein for receiving the metal parts, and wherein the metal parts forming an anode in said receiving space so that the metal parts can be electropolished.

* * * * *

UNITED STATES PATENT AND TRADEMARK OFFICE

CERTIFICATE OF CORRECTION

PATENT NO. : 6,562,202 B2
DATED : May 13, 2003
INVENTOR(S) : Beier et al.

It is certified that error appears in the above-identified patent and that said Letters Patent is hereby corrected as shown below:

Column 4,
Line 20, after the word "rod", please delete the word "tar" and insert -- for --.

Signed and Sealed this

Nineteenth Day of August, 2003

JAMES E. ROGAN
*Director of the United States Patent and Trademark Office*